US006283214B1

(12) United States Patent
Guinot et al.

(10) Patent No.: US 6,283,214 B1
(45) Date of Patent: Sep. 4, 2001

(54) OPTIMUM PERFORATION DESIGN AND TECHNIQUE TO MINIMIZE SAND INTRUSION

(75) Inventors: Frederic J. Guinot, Houston; Simon G. James, Stafford; Brenden M. Grove, Missouri City, all of TX (US); Panos Papanastasiou, Hardwick (GB)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/321,040

(22) Filed: May 27, 1999

(51) Int. Cl.[7] ..... E21B 43/117

(52) U.S. Cl. ..... 166/297; 166/55.2; 175/4.51; 175/4.6; 102/313

(58) Field of Search ..... 166/297, 55, 55.2; 175/4.51, 4.6; 102/306, 313

(56) References Cited

U.S. PATENT DOCUMENTS

| | | | | |
|---|---|---|---|---|
| 3,242,987 | * | 3/1966 | LeBourg | 175/4.6 X |
| 4,071,096 | * | 1/1978 | Dines | 175/4.6 |
| 5,386,875 | | 2/1995 | Venditto et al. . | |
| 5,633,475 | * | 5/1997 | Chawla | 102/306 |
| 5,792,977 | | 8/1998 | Chawla . | |
| 5,797,464 | | 8/1998 | Pratt et al. . | |

OTHER PUBLICATIONS

SPE 38939 "Coupling Reservoir and Geomechanics to Interpret Tidal Effects in a Well II Test" Pinilla, et al, Oct. 1997.
SPE 36457 "Fracturing, Frac–Packing and Formation Failure Control: Can Screenless Completions Prevent Sand Production?" Morita, et al, Oct. 1996.
SPE 51187 (Revised from SPE 36457) "Fracturing, Frac–Packing and Formation Failure Control: Can Screenless Completions Prevent Sand Production?" , Morita, et al, Mar. 1998.

* cited by examiner

*Primary Examiner*—Roger Schoeppel
(74) *Attorney, Agent, or Firm*—Trop, Pruner & Hu & P.C.

(57) ABSTRACT

The present Invention relates to novel devices and methods to minimize the production of sand in subterranean environments; in particular, in poorly consolidated formations, sand is often co-produced along with the desired fluid (e.g., oil); sand production is undesirable, hence in the present Invention, elliptically shaped perforations of a particular orientation are created in the casing (or directly into the formation in the case of an uncased wellbore) that lines wellbore drilled through the formation, to improve near-wellbore stability of the formation, hence minimizing sand intrusion.

31 Claims, 11 Drawing Sheets

HYDROCODE SIMULATION 12.5 μSECONDS

22g CHARGE ELLIPSE 3 JET & HOLE PROFILE

HYDROCODE SIMULATION 12.5 μSECONDS

22g CHARGE ELLIPSE 2 JET & HOLE PROFILE

HYDROCODE SIMULATION 12.5 μSECONDS

22g CHARGE ELLIPSE 2 JET & HOLE PROFILE

HYDROCODE SIMULATION 12.5 μSECONDS

22g CHARGE ELLIPSE 3 JET & HOLE PROFILE

HYDROCODE SIMULATION 12.5 μSECONDS

22g CHARGE ELLIPSE 3 JET & HOLE PROFILE

OPTIMUM PERFORATION DESIGN AND TECHNIQUE TO MINIMIZE SAND INTRUSION

BACKGROUND

1. Technical Field of this Invention

The present Invention relates to novel devices and methods to minimize the production of sand in subterranean environments. In particular, in poorly consolidated formations, for instance, sand is co-produced along with the desired fluid (e.g., oil); sand production is undesirable, hence in the present Invention, elliptically shaped perforations of a particular orientation (in preferred embodiments) are created through the casing that lines the wellbore (as well as created in an uncased formation) and that penetrate the formation rock, to improve the stability of the perforation tunnel, and therefore minimizing sand intrusion (or the intrusion of disaggregated formation particles generally, in the case of, e.g., carbonate formations).

2. Prior Art

In the production of oil and gas from a subterranean reservoir, one persistent problem in certain types of reservoirs is that sand is also produced along with the hydrocarbon. The present Invention is directed to novel techniques to control the coproduction of sand with hydrocarbons (i.e., "sand control"). Obviously, the goal in oil and gas production is to move the hydrocarbon from the underground formation where it resides, to a wellbore drilled in the earth, and eventually to the surface, for transportation and eventual refining. Many hydrocarbon-bearing formations are sandstone, and many of those are poorly consolidated sandstone, which means that the sand grains that comprise the geologic formation are loosely held together. In certain formations, sand flows from the formation along with the oil—this may occur initially, or later in the life of the well. This "sand production" is highly undesirable. For one thing, sand is a harsh abrasive and so abrades just about everything it comes in contact with—production string (generally steel tubing) lining the wellbore, aboveground pipelines, and so forth. If enough sand is co-produced with the oil then it is not even suitable for processing, or only at substantial additional expense.

Therefore, numerous techniques have evolved to deal with the problem; they are roughly divisible into two categories: mechanical and non-mechanical. The primary mechanical technique is known as "gravel packing." A particularly sophisticated type of gravel packing is AllPAC, a patented technology jointly developed by Mobil and Schlumberger and exclusively licensed to Schlumberger. (See, e.g., L. G. Jones, *Alternate-Path Gravel Packing*, SPE 22796 (1991)). The idea behind gravel packing is to place a permeable screen inside the wellbore between the casing (if there is one) and the wellbore, next the annulus formed by the screen and casing/wellbore is filled with gravel. (Alternatively, a screen without gravel is sometimes used; also, sometimes "pre-packed" screens are used, in which the gravel is placed in the screen before it is placed in the wellbore). The purpose of the screen is to hold the gravel in place, and the purpose of the gravel (and screen) is to remove the sand, yet allow the oil (or gas) to migrate through the gravel pack, into the wellbore and eventually to the surface.

Although gravel packing is a venerable sand control technique, still widely relied upon, it has numerous very substantial disadvantages. First, screens are very expensive; this expense is naturally exacerbated in horizontal wells, where the amount of screen needed frequently exceeds a thousand feet. Moreover, placing a screen in a horizontal section is time-consuming and expensive. Second, a rig or mast must be used to place screen in a wellbore; rig rates are quite often very high, particularly offshore (e.g., in the North Sea, they can exceed $100,000/day). Third, whatever benefit—in reduced sand production—is derived from the gravel pack, the fact remains that it is a choke on production, often substantially reducing potential production rates. Related to this, screens can become plugged—e.g., by fines (very small grain sands) may become affixed to the screen face where they form a "filter cake," which can severely inhibit, or even halt production.

The second major category of sand control techniques relates not to impeding the flow of sand via a filter (gravel pack) but instead relates to improving the near-wellbore integrity of the formation so that less sand flows into the wellbore. For the most part, these techniques involve somehow consolidating the sandstone around the wellbore—i.e., cementing the sand grains together so that they do not flow along with the oil, into the wellbore. To do this requires some sort of cementing material, such as a furan resin or epoxy resin. For instance, U.S. Pat. No. 5,551,514, assigned to Schlumberger, discloses and claims, e.g., a method of controlling sand production by consolidating the near-wellbore formation by injecting a resin into that region of the formation. Next, that portion of the formation is hydraulically fractured—i.e., sufficient fluid is pumped into the formation to cause it to split. The idea is that formation consolidation is achieved (via the resin) but not at the expense of reduced hydrocarbon production (since the formation is actually stimulated by the fracture).

These non-mechanical (or chemical) sand control techniques suffer predictably, from reduced permeability in the region of the formation where the consolidation is placed. In other words, while the idea behind these types of treatments is to cement the contiguous sand grains together, but not leave the resin in the pore spaces (where the oil must flow), most treatments rarely approach this ideal. Indeed, to remove the resin from the pore spaces requires that still more chemicals be pumped into the reservoir to "flush" the resin from the pore spaces; still more chemicals are required in some cases, to "pre-treat" the sand grains so that the resin sticks to the sand grains preferentially (hence resists the flushing step) but is readily removable from the (un-pre-treated) pore spaces.

The present Invention is also directed to sand control, but fits in neither of these categories. That is, it is neither mechanical nor chemical. The present Invention shall be explained below with reference to certain prior art.

One of the first steps in oil and gas production is drilling a wellbore into the hydrocarbon-bearing formation. Next, a casing (liner), generally steel, is inserted into the wellbore, and forms a gap between the casing and wellbore, typically referred to as the annulus. Once the casing is inserted into the wellbore, it is then cemented in place, by pumping cement into the annulus. The reasons for doing this are many, but essentially, a liner helps ensure the integrity of the wellbore, i.e., so that it does not collapse; another reason for the wellbore liner is to isolate different geologic zones, e.g., an oil-bearing zone from an (undesirable water-bearing zone). By placing a liner in the wellbore and cementing the liner to the wellbore, then selectively placing holes in a liner cemented to the wellbore, one can effectively isolate certain portions of the subsurface, for instance to avoid the co-production of water along with oil.

That process of selectively placing holes in the liner and cement so that oil and gas can flow from the formation into the wellbore and eventually to the surface is generally known as "perforating." One common way to do this is to lower a perforating gun into the wellbore using a wireline or slickline, to the desired depth, then detonate a shaped charge within the gun. The shaped charge creates a hole in the adjacent wellbore liner and formation behind the liner. This hole is known as a "perforation." Perforating guns are comprised of a shaped charge mounted on a base. U.S. Pat. No. 5,816,343, assigned to Schlumberger Technology Corporation, incorporated by reference in its entirety, discusses prior art perforating systems (e.g., col. 1., 1. 17).

We are aware of one group that has examined the role of perforation stability on sand production. See, N. Morita, *Fracturing, Frac Packing, and Formation Failure Control: Can Screenless Completions Prevent Sand Production*? SPE 36457 (1998). For instance, these investigators note that "Perforation stability significantly improves if the perforations are shot in the maximum horizontal in-situ stress direction, if the two principal horizontal stresses are significantly different, or the perforations can be shot in the well azimuth direction if the well is highly inclined." Id. at 395. Yet this articles neither discloses nor suggests a particular perforation geometry (other than circular) and particular orientation (since that only has meaning if the perforations are non-circular)

In addition, U.S. Pat. No. 5,386,875, Method for Controlling Sand Production of Relatively Unconsolidated Formations (assigned to Halliburton) is directed to a method for controlling sand production by optimizing perforation orientation. This patent differs from the present Invention in part because the '875 patent neither claims, discloses, nor suggests optimizing the geometry of the perforations (i.e., their shape), but instead is directed solely to their orientation around the well casing.

The present Invention relates to a method of controlling the production of sand, based on optimizing the geometry and the orientation of perforations. Hence, this method suffers from none of the difficulties which plague conventional sand control techniques—e.g., cost (screens) and diminished permeability (resin consolidation).

SUMMARY OF THE INVENTION

We have found that perforations having a particular geometry and orientation, impart greater stability to the formation surrounding the perforation tunnel. Greater stability in turn means less disaggregation of the individual particles that comprise the formation (i.e., sand in the case of a sandstone formation). By "geometry" we mean that the perforations are ideally elliptically shaped—when viewed in cross section perpendicular to an axis defined by the direction of the perforation tunnel. By "orientation" we mean that the perforation (again defined as the roughly largest cross section perpendicular to an axis defined by the perforation tunnel): (1) has its major(long) axis substantially parallel to a plane perpendicular to an axis defined by the perforation tunnel; and (2) that major axis is substantially aligned in the direction of maximum compressive stress in that plane. In other words, item (1) fixes the perforation's orientation somewhere in a given plane; item (2) fixes the perforation's long axis within that plane.

What we have found is that a particular shape and orientation of the perforation minimizes this destabilization, hence also minimizes sand production. In particular, and in the specific case of a vertical wellbore, for instance, elliptically shaped perforations, having the major axis aligned in the direction of maximum principal in situ, or compressive stress, improve the stability of the formation in the region near the wellbore, hence minimizing sand intrusion. Particularly preferred embodiments of this aspect of the Invention are perforations with an aspect ratio of about 5:1, and having their principal axis substantially aligned (± about 10°) with the direction of maximum compressive stress.

Having shown that the benefit of producing such unusually shaped perforations, another aspect of the present Invention relates to perforating guns (or the shaped charges deployed within the guns) modified to produce such perforations. In preferred embodiments, the shaped charge is modified by making the case exterior more oval-shaped. In particularly preferred embodiments, the shaped charge is modified by modifying the case exterior and interior in accordance with the disclosure below.

As evidenced by our preceding remarks, the present Invention has numerous advantages over the state-of-the-art sand control techniques. For one thing, all of the significant disadvantages associated with screen placement are avoided, and for another, no chemicals are pumped in the formation, which inevitably lead to a loss in permeability. In addition, the sand control measures of the present Invention are not exclusive—that is, they can be used to supplement existing techniques, e.g., a screen-only completion. Put another way, all cased wellbores must be perforated—regardless of whether they are later gravel packed or resin consolidated, etc.

We wish also to note that the present Invention is applicable not just in poorly consolidated formations, but rather is a more general system for imparting greater in stability on well consolidated formations. For one thing, some of these may not produce sand initially, but may much later. In addition, the present Invention can be relied upon to stabilize formations other than sandstones, for instance carbonate formations as well; however, for convenience sake, we shall use the shorthand "sand" to refer to particles that disaggregate from the formation, whether sandstone or carbonate, etc. Indeed, not only is the present Invention also suitable for other than poorly consolidated sandstone formations (subject to immediate sanding) in fact it is best suited to other than totally unconsolidated formations. By "totally unconsolidated formations" we mean formations subject to perforation tunnel collapse shortly after the perforation was shot. Obviously, if the formation will not support a perforation tunnel, then the present Invention is essentially inoperable.

BRIEF DESCRIPTION OF THE FIGURES

FIG. 12 is a three-dimensional computer-drawn picture of a conventional shaped charge (22 g HMX deep-penetrating charge used in a 3 ⅜' perforating gun) modified by a small change to the case exterior (made more elliptical).

FIG. 13 is a three-dimensional computer-drawn picture of a conventional shaped charge (22 g HMX deep-penetrating charge used in a 3 ⅜' perforating gun) modified by a substantial change to the case interior (made more elliptical).

FIG. 14 is a three-dimensional computer-drawn picture of a conventional shaped charge (22 g HMX deep-penetrating charge used in a 3 ⅜' perforating gun) modified by small changes to the case exterior and interior (made more elliptical).

15*b* shows the jet tip.

FIG. 16 is a computer-simulated picture of the collapsing liner and jet, viewed parallel with the trajectory. This Figure shows the jet produced (at 12.5 microseconds) from the modified shaped charge in FIG. 13.

Figure 16A:
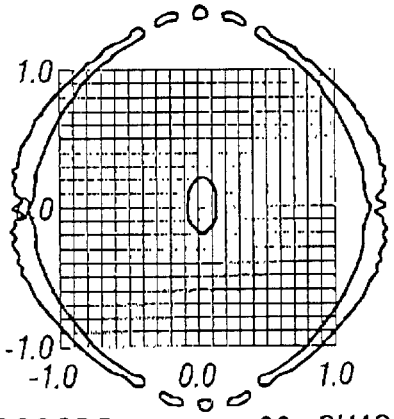

FIG. 16*a* (left) shows the jet midsection, and 16*b* shows the jet tip.

FIG. 17 is a computer-simulated picture of the collapsing liner and jet, viewed parallel with the trajectory. This Figure shows the jet produced (at 12.5 microseconds) from the modified shaped charge in FIG. 14.

Figure 17A:
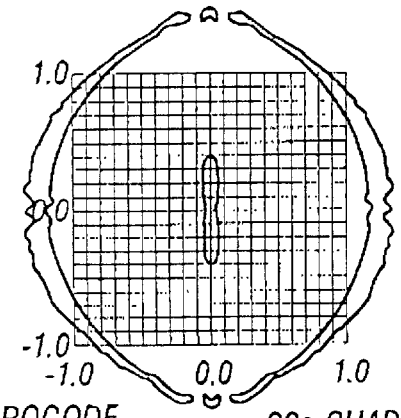

FIG. 17*a* (left) shows the jet midsection, and 17*b* shows the jet tip.

Figure 18:
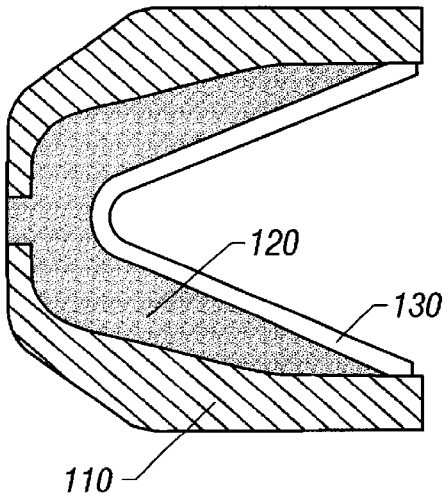

FIG. 18 is a side-view schematic of a conventional shaped charge (for convenient comparison with FIG. 19 below) showing the primary features of the charge: case, explosive, and liner.

Figure 19A:
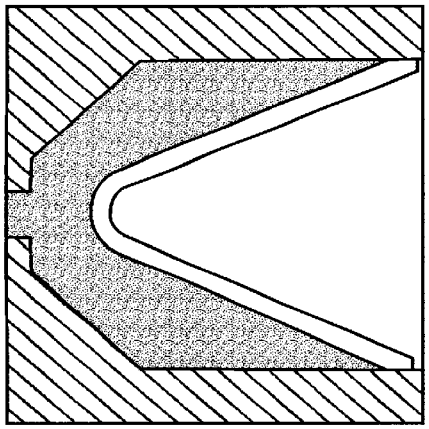
Figure 19B:
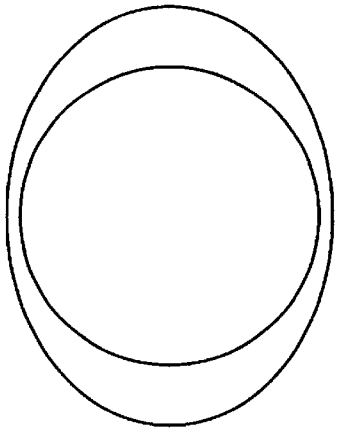
Figure 19C:
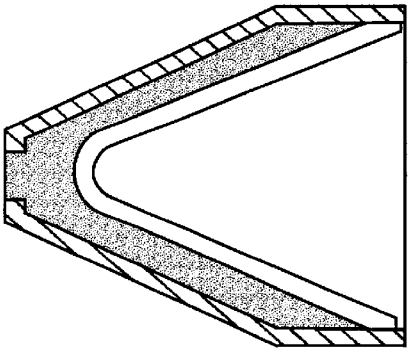
Figure 19D:
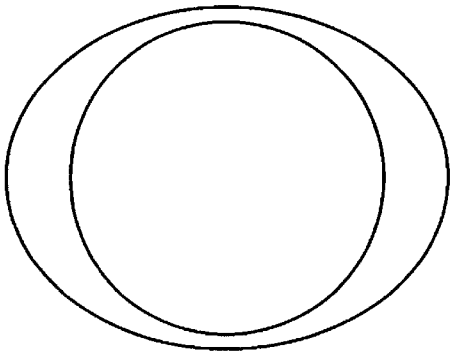

FIG. 19 is a schematic of a shape charge modified in accordance with the present Invention; 19*a* is a side-view; 19*b* the corresponding view from the rear of the charge;

FIGS. 19*b* and 19*c* show the identical shaped charge, except that the charge has been rotated 90°; 19*d* shows the back view corresponding to FIG. 19*c*.

DETAILED DESCRIPTION OF THE PREFERRED EMBODIMENTS

We have found that perforations having a particular geometry and orientation, impart greater stability to the formation surrounding the perforation tunnel. The term "greater stability" means that as oil flows from the formation, through the perforation and into the wellbore, it has an obvious destabilizing effect on the geologic formation near the perforation—i.e., it tends to cause it to break down, or to cause the individual sand grains to slough off from the formation and migrate towards the wellbore, carried by the oil. In other words, breakdown of the formation in the region near the wellbore (and hence the perforation) leads to sand production (assume that the formation is a loosely consolidated sandstone formation, hence as it weakens, loose sand grains disaggregate from the formation).

Before going further, we wish to define several additional terms which are critical to properly understand the present Invention. One concept crucial to the present Invention is "orientation," another is "perforation." As used here, orientation can refer either to the orientation of the perforation tunnel axis or the orientation of the major axis of the elliptically shaped perforation. The difference between these two meanings of the same term needs to be understood; in each instance here, the meaning intended by us is either expressly stated or is clear from context.

Figure 1A:
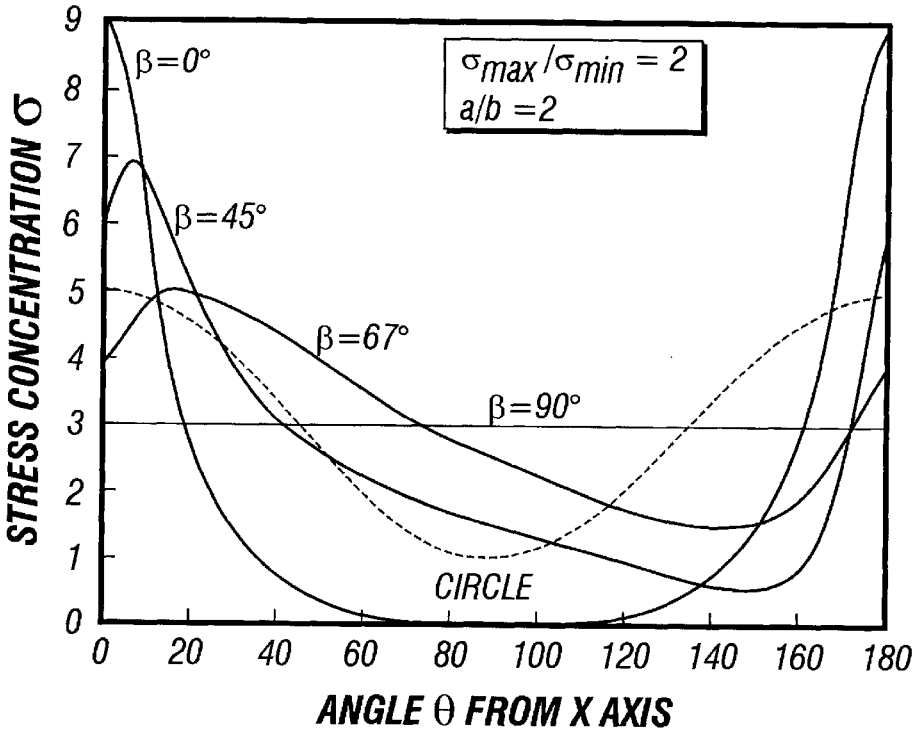
FIG. 1*a* depicts stress concentration ($\sigma$) as a function of the angle $\theta$ from the x-axis for a circular shaped perforation as well as elliptically shaped perforations of different orientations with respect to the principal axis.
Figure 1B:
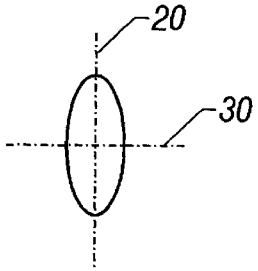
FIGS. 1*b*, 1*c*, and 1*d* define what we mean by "perforation orientation" (and related terms) as well as illustrate the requirement for preferred embodiments that the perforations be orientated in a particular way.
Figure 1C:
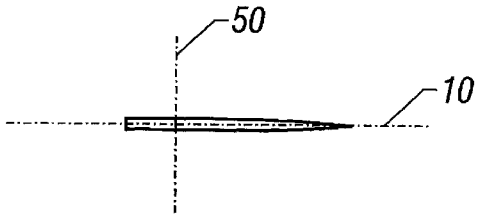
Figure 1D:
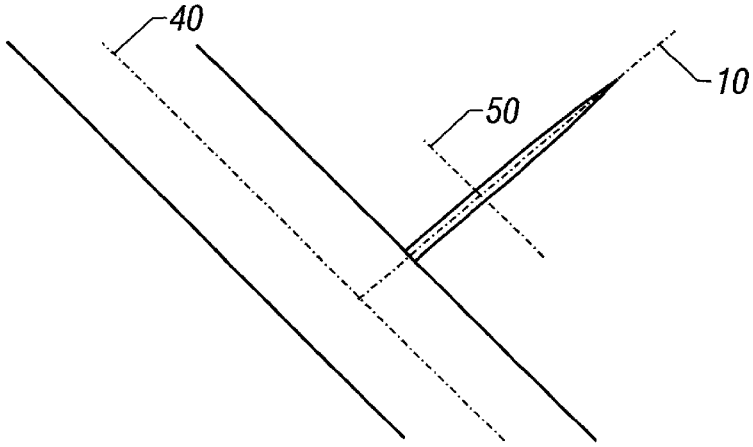

To best understand these terms, refer to FIGS. 1*b*, 1*c*, and 1*d*. FIG. 1*c* shows an axis 10 defined by the direction of the perforation tunnel (the direction in which the jet traveled to create the perforation). That is one of the two crucial axes. The other is shown in FIG. 1*b*. Again, in preferred embodiments of the present Invention the perforation is an ellipse; that ellipse is defined by a cross-section (cross-section with respect to the axis shown at 10. Hence, as shown in FIG. 1*b*, the term "ellipse," "perforation orientation," and in particular "perforation," refer to the perforation's cross-section: The orientation of that perforation has a major (or long) axis 20 and a minor (or short) axis 30.

FIG. 1*d* shows a perforation shot in a deviated wellbore 40. (This discussion subsumes the vertical and horizontal wellbore cases as well.) As we shall discuss in far more detail below, particularly preferred embodiments of the present Invention require that the perforation (again defined as a cross-section, as shown in FIG. 1*b*): (1) have its major axis 20 substantially aligned ("substantially" in this context shall be more precisely defined later) in the direction of a plane perpendicular to the axis formed by the perforation tunnel (shown at 10); this plane is shown at 50; and (2) this major axis is substantially aligned in the direction of the formation's maximum compressive stress.

Having defined crucial terms, we now turn to a discussion of the preferred embodiments of the present Invention. We wish to note that for clarity's sake, the discussion that follows is directed to a vertical wellbore, a perforation tunnel shot 90° from that wellbore, and the direction of maximum compressive stress is vertical.

Again, conventional methods of sand control are roughly classifiable into either (1) screens, or (2) chemical consolidation. Chemical consolidation, even if performed properly, can lead to diminished permeability of the formation. The disadvantages of screens are numerous. See, for instance, N. Morita, *Fracturing, Frac Packing, and Formation Failure Control: Can Screenless Completions Prevent Sand Production*? SPE 36457 (1998). This article is hereby incorporated by reference in its entirety. (This article also discusses other types of "screenless completions, or means of controlling sand production without the use of a screen, not discussed here.)

The present Invention is premised upon the insight that elliptically shaped perforations, having their major axis substantially parallel to the direction of major principal compressive stress, is much more stable, than a perforation of circular cross-section area having identical flow capacity. By "stable" we mean that the perforation, or the formation around the perforation, can experience greater drawdown and depletion before the production of sand occurs. In other words, one particularly preferred set of embodiments of this invention relates to methods for controlling sand production, comprising shooting elliptically shaped perforations.

The enabling support for the present Invention is based in part upon three separate detailed studies: (1) an elastic stress analysis to show enhanced nearwellbore formation stability of elliptically shaped perforations; (2) finite element analysis to corroborate the (1); and (3) numerical modeling to design a shaped charge in a perforating gun that will create elliptically shaped perforations.

EXAMPLE 1

Elastic Stress Analysis

Persons familiar with the teachings in petroleum engineering, and in particular drilling, know that wellbores drilled parallel to the maximum compressive stress are more stable—i.e., they resist collapse—because the difference between the other two stresses acting on a plane perpendicular to the wellbore axis is minimized—resulting in reduced stress concentrated near the borehole wall.

And yet in the case of perforations, the situation is far more complicated. Perforations are generally shot in a stress field of unequal compressive stresses—since the vertical stress is normally higher than the horizontal stresses. Although the differential among all stresses is not large, the ratio between effective compressive stresses is generally much higher. In cases where the orientation of perforations to the direction of maximum stability is not possible due to technical considerations (e.g., perforations are shot perpendicular to the borehole wall), the risk of perforation failure can be minimized if the shear stress around the perforation wall is distributed uniformly. According to the present Invention, this is accomplished—i.e., uniformly distribute the shear stress thus avoiding excessive stress concentration in the direction of breakouts—by shooting elliptically shaped perforations instead of cylindrical shaped ones. The study that follows, as well as the one presented in Example 2, provides exhaustive support for that conclusion.

The purpose of this study is to investigate the ideal orientation and geometry of perforations—to permit the highest drawdown and depletion before sanding.

First, consider an ellipse with aspect ratio (a/b) embedded in a stress field of two principal stresses at infinite $\sigma_1$ and $\sigma_2$. The stress $\sigma_2$ is inclined at angle $\beta$ to the x axis. The stress $\sigma_1$ is inclined at an angle $90°+\beta$. The tangential surface stress, $\sigma_t$ around the elliptical hole is given by:

$$\sigma_t = \frac{2ab(\sigma_1+\sigma_2) + (\sigma_1+\sigma_2)[(a+b)^2\cos 2(\beta-\eta) - (a^2-b^2)\cos 2\beta}{a^2+b^2-(a^2-b^2)\cos 2\eta} \quad (1)$$

where $\eta$ is the eccentric angle borrowed from the theory of conic sections. This angle $\eta$ is related to the polar angle $\theta$ via $\tan\theta=(b/a)\tan\eta$. Model calculations are based on a stress field ratio of $\sigma_1/\sigma_2=2\sigma/\sigma$; and a perforation aspect ratio of a/b=2.

FIG. 1 shows the variation of the tangential surface stress $\sigma_t$ with polar angle $\sigma$ for different orientations of the stress field with respect to the ellipse (i.e., the orientation of the ellipse). In particular, FIG. 1 presents modeling results for a circular shaped perforation as well as elliptically shaped perforations of different orientations with respect to the principal axis.

Thus, according to FIG. 1, for a circular perforation, hole collapse is expected to occur at $\sigma=0$ where the stress concentration is $\sigma_t=3\sigma_1-\sigma_2=5\sigma$. Hydraulic fracture will initiate at $\sigma=90$, where the stress concentration is minimum: $\sigma_t=3\sigma_2-\sigma_1=\sigma$.

In an elliptical hole with the major axis a parallel to the minimum compressive stress (hence $\beta=0$), the stress concentration at $\theta=0$ or 180° is $\sigma_t=9\sigma$ which is much higher compared to the stress concentration of the circular hole. In other words, an elliptical perforation is expected to be less stable than the circular perforation, at $\beta=0$. Now, imagine that the elliptical perforation is rotated 90° (i.e., $\beta=90$); i.e., now the major axis of the ellipse is aligned with the direction of maximum stress, $\sigma_1$. In this case, the stress concentration is uniformly distributed around the surface of the hole with a value $\sigma_t=3\sigma$. Again, the ratio of the ellipse axis is the same as the ratio of principal stresses at infinity. Hence, as evidenced by FIG. 1, a particularly stable type of perforation geometry is an ellipse, provided that its major axis is parallel to the maximum compressive stress.

In most applications, the vertical compressive stress is the major principal stress. In these instances, the elliptical shaped perforations will be shot such that the major axis is vertical. As we have discussed, that is the ideal situation; nevertheless, the risk of misalignment is no doubt present. FIG. 1 also presents data showing the effect of different misalignment on stress concentration. As evidenced by these data, as long as the major axis is within about 23° of the ideal case ($\beta=90$) then an elliptical hole is more stable than a circular one.

EXAMPLE 2

Finite Element Analysis

The Example just presented, shows that according to elastic stress analysis, an elliptical hole suffers less stress concentration than a circular hole when its major axis is aligned with the direction of the major principal stress. That analysis does not account for imperfectly elastic properties of the rock (i.e., formation rock has a narrow elastic domain).

Put another way, the prior analysis does not guarantee that the elliptical perforation will be more stable than the circular perforation, since the curvature of the elliptical hole is different than the curvature of the circular hole. For instance, based on previous modeling studies performed by us, an increase of tangential stress may cause surface buckling. This may result in surface buckling, which in turn results in localization of deformation in shear bands, leading ultimately to failure in the form of breakouts. We have found that surface buckling of a borehole depends on its curvature.

Therefore, in order to examine the stability of elliptically shaped perforations and the corresponding jet, or penetration profile into the formation, we have developed a finite element-based model to predict surface buckling and localization of deformation. The model is based on bifurcation theory in addition to a modified flow theory for a Mohr-Coulomb material with Cosserat microstructure. This model is capable of predicting the existing scale effect in small-sized holes, such as perforations (small holes are more stable than larger ones). Material input parameters were obtained by triaxial tests on Castlegate sandstone. An extra calibration constant is used to define the material softening required for triggering localization. In addition, the grain size is a required model input parameter—e.g., for Castlegate sandstone, the grain diameter is 0.2 mm.

Figure 2:
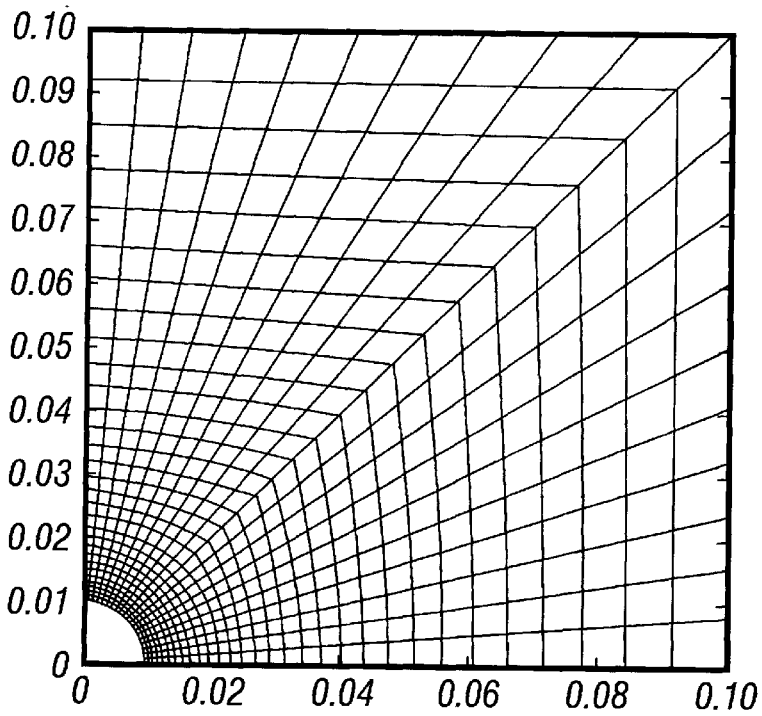
FIG. 2 shows a discretized domain in a stress field for a quarter section of a circular perforation.
Figure 3:
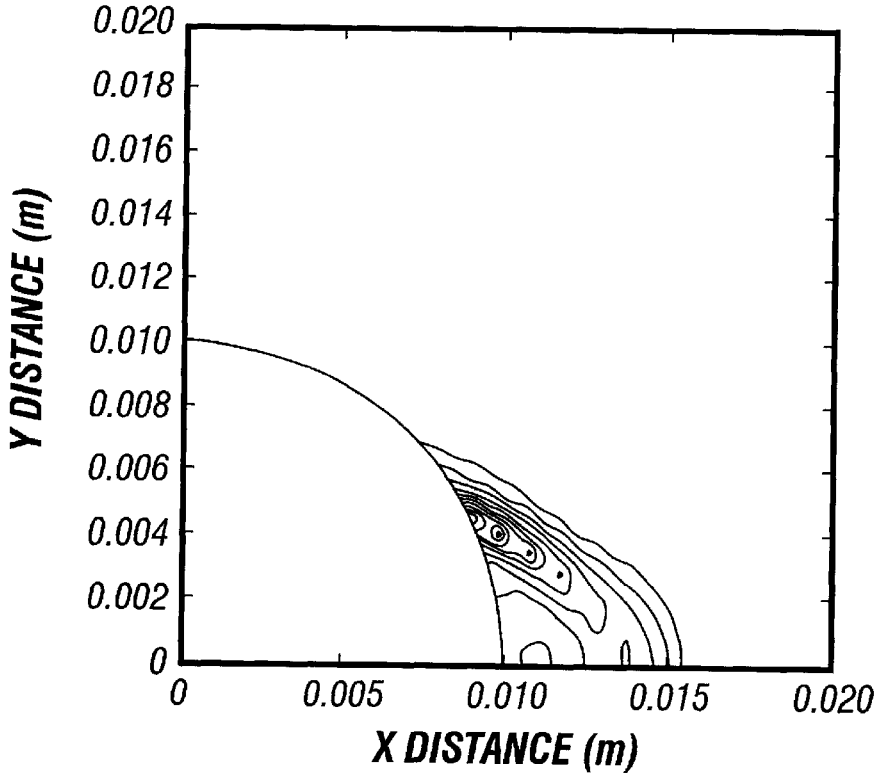
FIG. 3 shows contours of shear plastic strain after localization of deformation.
Figure 4:
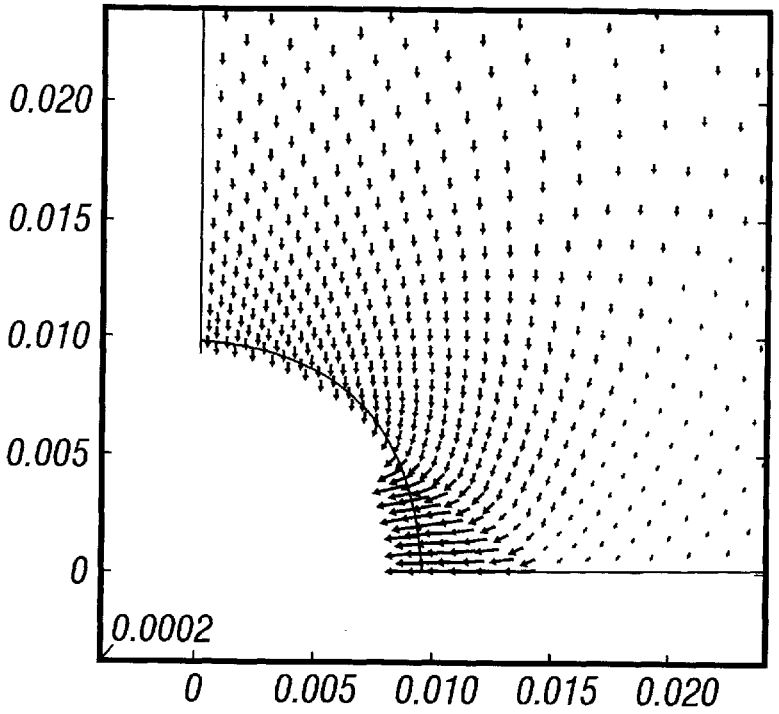
FIG. 4 shows a displacement field in the vicinity of a circular perforation.
Figure 5:
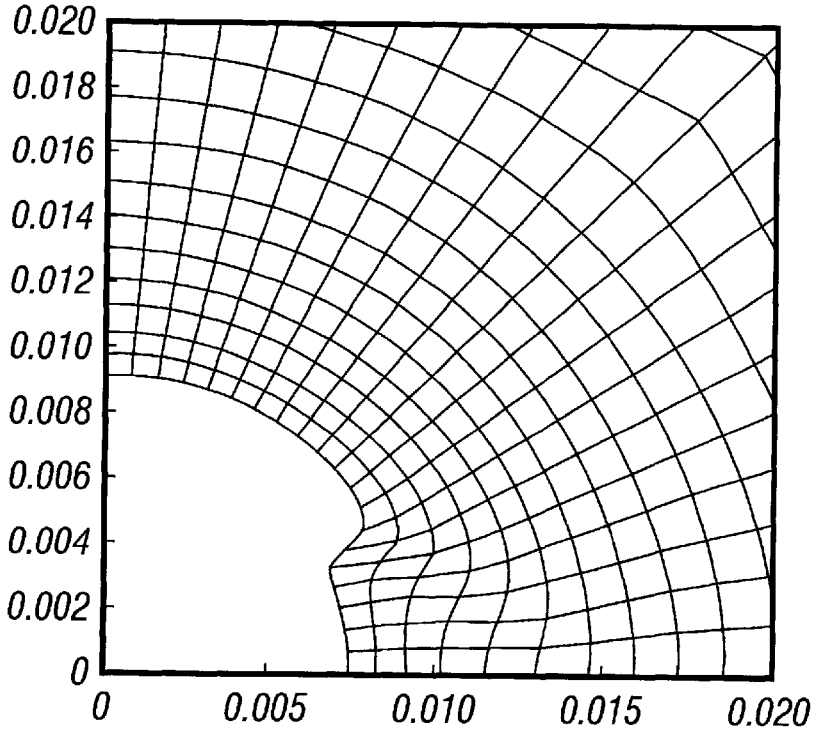
FIG. 5 shows a deformed mesh in the vicinity of a circular perforation.

First, we performed computations for a circular perforation with radius r=0.01—this served as the benchmark for later comparison. Due to the complete symmetry of a circle, only a quarter section was discretized (FIG. 2). The external boundary was defined to be at least 10 times the radius of the hole in order to eliminate boundary effects. The stresses were applied incrementally with constant ratio $\sigma_y/\sigma_x=2$. The solution was controlled by decreasing the cross-sectional area while the stress level was determined indirectly (displacement control). Localization of deformation has occurred after the applied stress reached $\sigma_x=24$ MPa and $\sigma_y=48$ MPa. FIG. 3 shows the contours of plastic strain after localization of deformation. FIG. 4 shows the total displacement field; FIG. 5 shows the deformed mesh in the vicinity of the hole. Again, the results presented in these Figures are valid for circular perforations.

Figure 6:
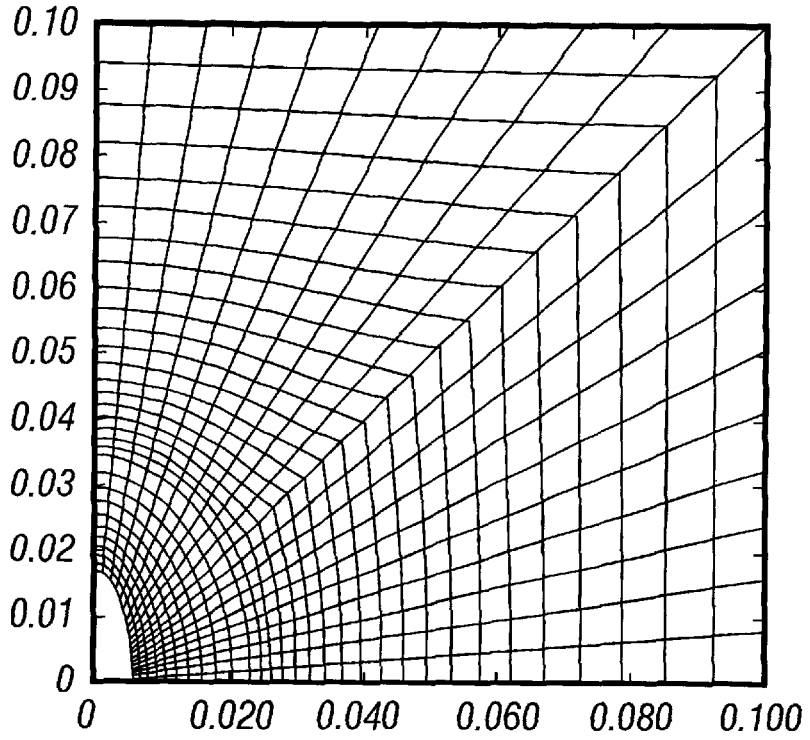
FIG. 6 shows a discretized domain in a stress field surrounding a quarter section of an elliptical perforation.
Figure 7:
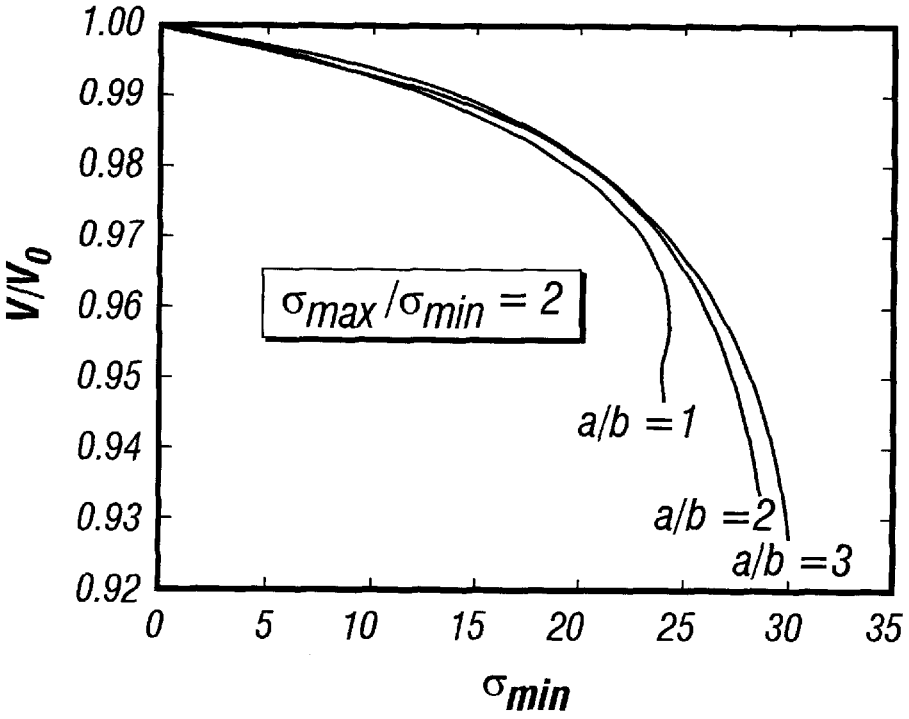
FIG. 7 shows the change of cross-sectional area with applied stress for elliptical and circular perforations having the same cross-sectional area.
Figure 8:
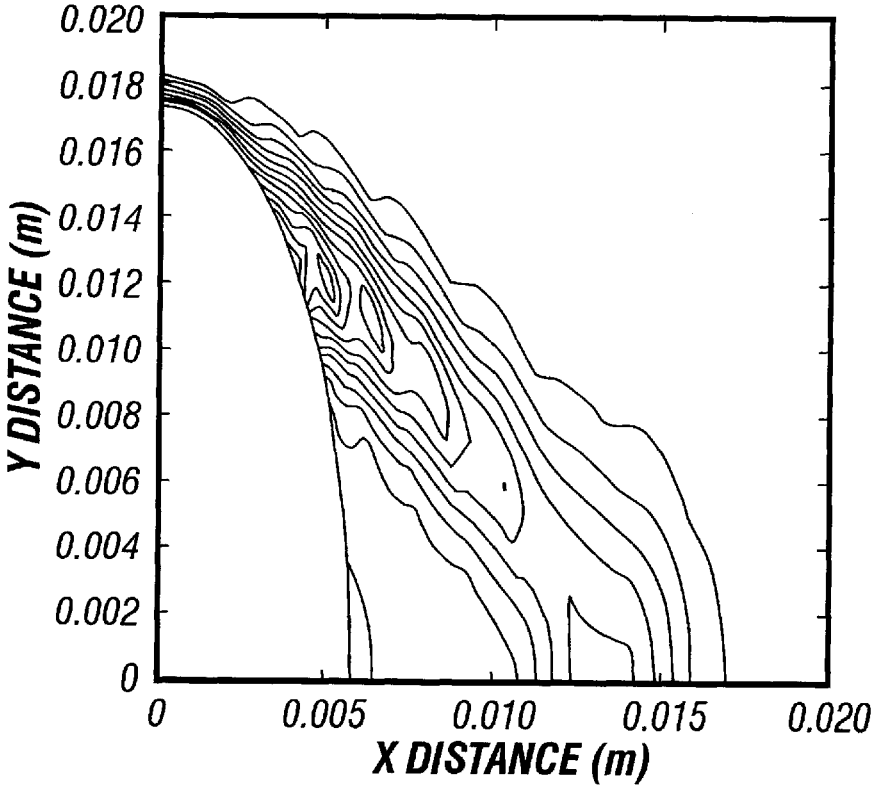
FIG. 8 shows contours of shear plastic strain after localization of deformation for an elliptically shaped perforation.
Figure 9:
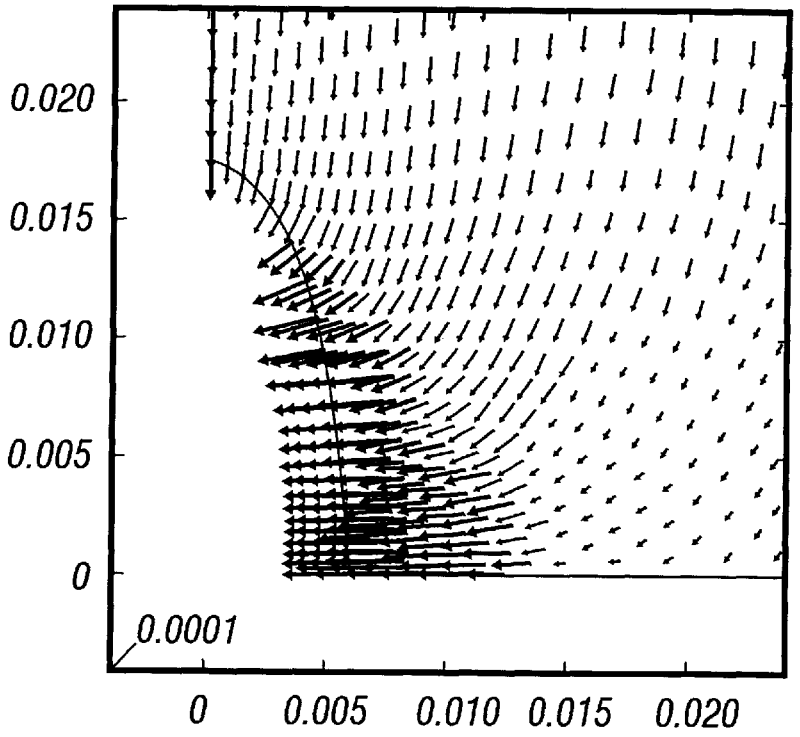
FIG. 9 shows a displacement field in the vicinity of an elliptically shaped perforation.
Figure 10:
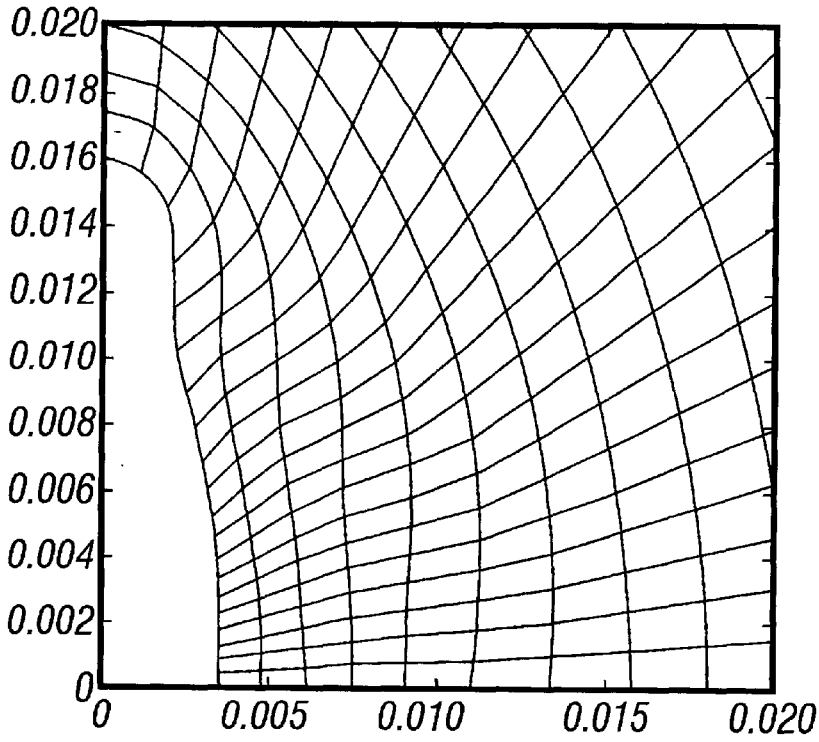
FIG. 10 shows a deformed mesh in the vicinity of an elliptically shaped perforation.
Figure 11:
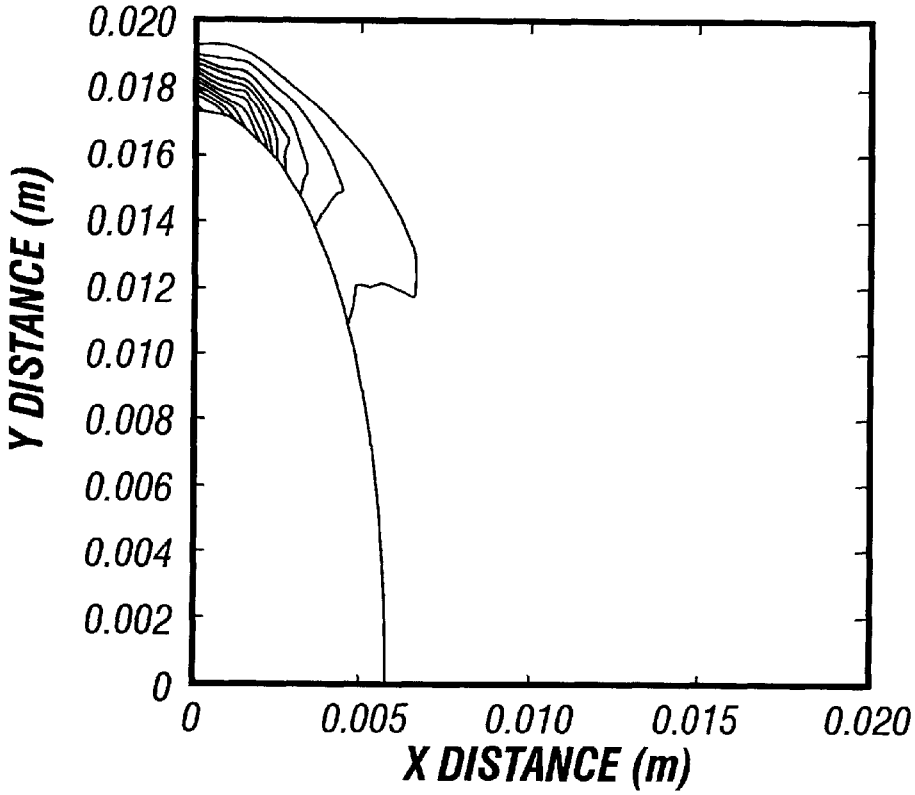
FIG. 11 shows contours of shear plastic strain after localization of deformation for an elliptically shaped perforation having an aspect ratio a/b=3, and applied stresses $\sigma_1/\sigma_2=1.5$.

Next, the model was applied to evaluate elliptically shaped perforations. As with the circular perforations, a quarter section of the perforation is shown in the relevant Figures. As evidenced from the results presented in Example 1 (the elastic strain analysis) the best ellipse orientation is alignment of the ellipse's major axis parallel to the axis of major principal stress, $\sigma_y$. As in the circular case, the same stress ratio $\sigma_y/\sigma_x=2$ was incrementally applied. The aspect ratio was, however, varied. Some modeling runs were performed using an aspect ratio of a/b=2; other modeling runs were performed using an aspect ratio of a/b=3. A typical mesh showing the discretization of the domain surrounding the ellipse is shown in FIG. 6. FIG. 7 shows the closure curve versus applied minimum stress, $\sigma_x(\sigma_y=2\sigma_x)$. The point at which the curve ends denotes failure. FIG. 7 indicates, for instance, that an elliptically shaped perforation with a larger aspect ratio fails at a higher minimum stress.

Finally, as evidenced by the above discussion, a poorly oriented elliptically shaped perforation may impart less stability to the contiguous formation than a round perforation. Indeed, due to the overburden stress, a perforation that "begins" as round may become elliptical due to overburden (with the principal axis aligned perpendicular to the maximum stress). The significance of this is that an even modestly elliptically shaped perforation may improve formation stability (compared with a perforation that is initially round), though it later becomes more round due to overburden stress.

EXAMPLE 3

Deviated and Horizontal Wells

We wish now to expand our discussion above to include deviated and pure horizontal wells. Above, we stated that the major axis of the ellipse should be orientated in the direction of maximum compressive stress for improved stability. This is generally true for vertical wells (the paradigm case upon which the preceding discussion was directed) in which the vertical stress is the maximum stress.

Obviously, in many cases, the vertical stress is not the maximum stress. In the case of horizontal wells, perforations shot vertically (up or down but not sideways) will be stabilized if the major axis of the ellipse is oriented in the direction of maximum horizontal stress; in horizontal wells, vertical stress does not influence perforation stability—in the specific case where the perforations are placed up or down (rather than sideways). Third, in the case of deviated wells, the particularly preferred embodiments of the present Invention require that one orient the major axis of the ellipse in the direction of maximum stress in the plane perpendicular to the perforation tunnel.

To generalize—that is, to cover all three cases, vertical, horizontal and deviated, (referring to FIGS. 1*b*, 1*c*, and 1*d*) the particularly preferred embodiments of the present Invention are satisfied by creating perforations having a particular orientation. Again, by "orientation" we mean the orientation of the major (largest) axis of the perforation cross-section, as shown in FIG. 1*b*. What is important (for preferred embodiments) is that this cross-section be aligned in a particular way. To understand that, we have chosen a particular reference point—an axis defined by the perforation tunnel, as shown in FIG. 1*c*. So, the most preferred embodiments of the present Invention are satisfied by creating perforations (again, a cross-section) substantially parallel to a plane drawn perpendicular to the axis defined by the perforation tunnel. This is shown in FIG. 1*d*.

EXAMPLE 4

Design of the Perforating Apparatus

Again, conventional practice in the art is to shoot circular perforations, not irregularly shaped perforations. In order to shoot elliptically shaped perforations, the perforating apparatus will need to be redesigned. That is the focus of this section.

This Example reports a series of three-dimensional numerical simulations to demonstrate the feasibility of creating elliptically shaped perforations using perforating shaped charges.

The software used to generate the simulations is commercially available—OTI*HULL (1). (See, e.g., HULL Documentation, Version 4 (1997), D. Matsuka, et al., Orlando Technology, Inc.) This (as well as other) hydrocode has been used since about the late 60's to solve ordinance-related problems, included detonation, explosive/metal interaction, shaped charge functioning, and hypervelocity impact. HULL solves the conservation equations of continuum mechanics, coupled with descriptive material models (equations of state & strength models). These equations are solved on a finite difference grid, and the solution is advanced explicitly in time. In an Eulerian framework, the grid points (cells) are fixed in space, and material flows through the cell boundaries.

In a particularly preferred embodiment of the present Invention, the perforating device used to create the desired elliptically shaped perforations is based closely upon a conventional gun design—that way, the cost associated with performing the methods of the present Invention is lowest. In other words, we sought a particular shaped charge design that would involve only a modest reconfiguration of an existing or conventional shaped charge.

We begin with a baseline charge of 22 g HMX deep-penetrating charge, used in Schlumberger's 3 ⅜' HSD gun system. The shaped charge consists of three primary components: the case, the explosive, and the liner. By modifying the liner one could create non-circular jets, such a modified shaped charge is less desirable since fabrication of such a liner is more difficult. By contrast, modifications to the case are comparatively easy to make, hence the design iterations were directed there. Naturally though, changes to the case will also change the explosive geometry.

Figure 12B:
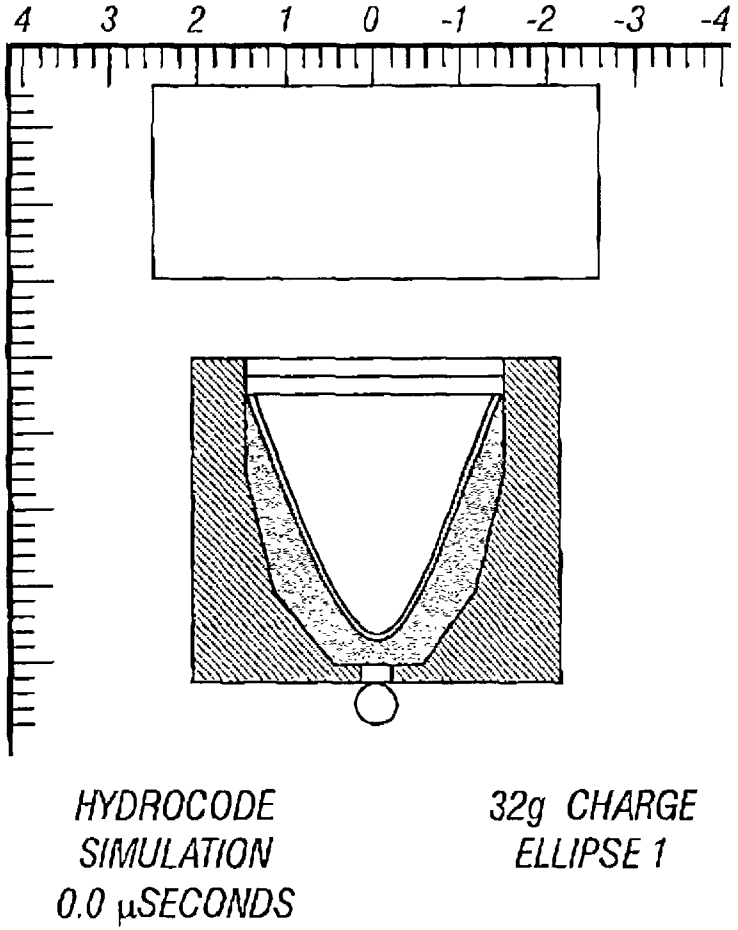
FIG. 12*b* is a view of the narrow side.
Figure 12A:
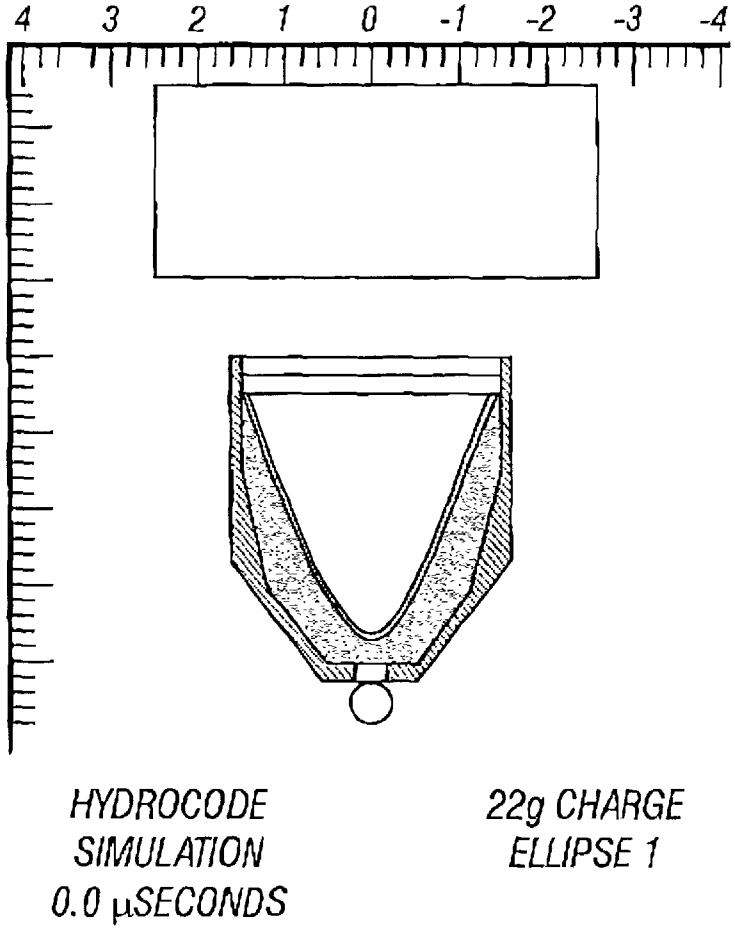
FIG. 12*a* is a side view from the widest portion of the charge.
Figure 13B:
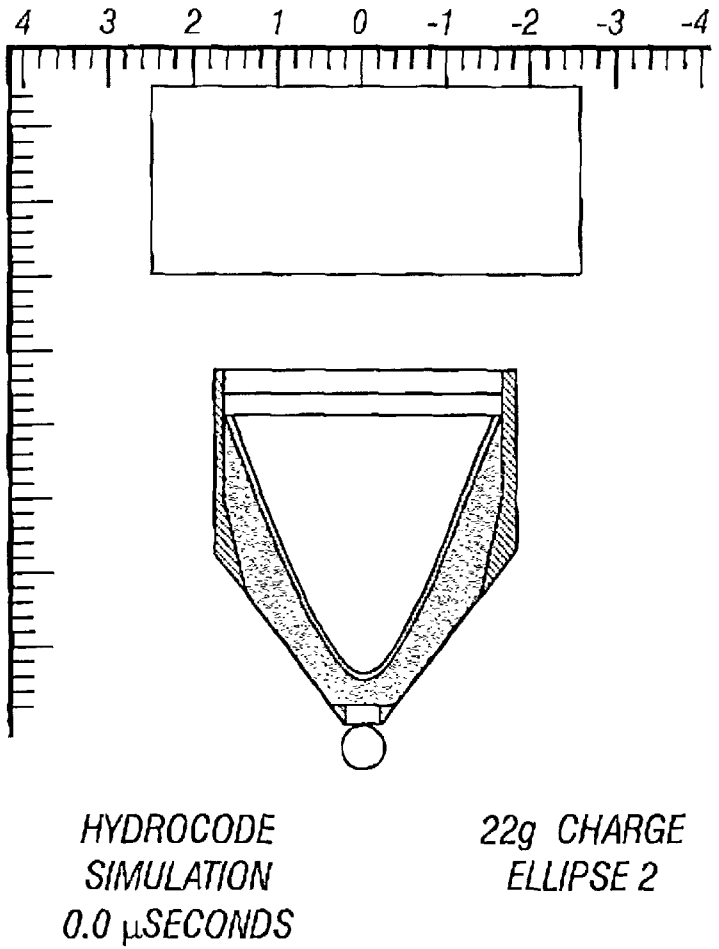
FIG. 13*b* is a view of the narrow side.
Figure 13A:
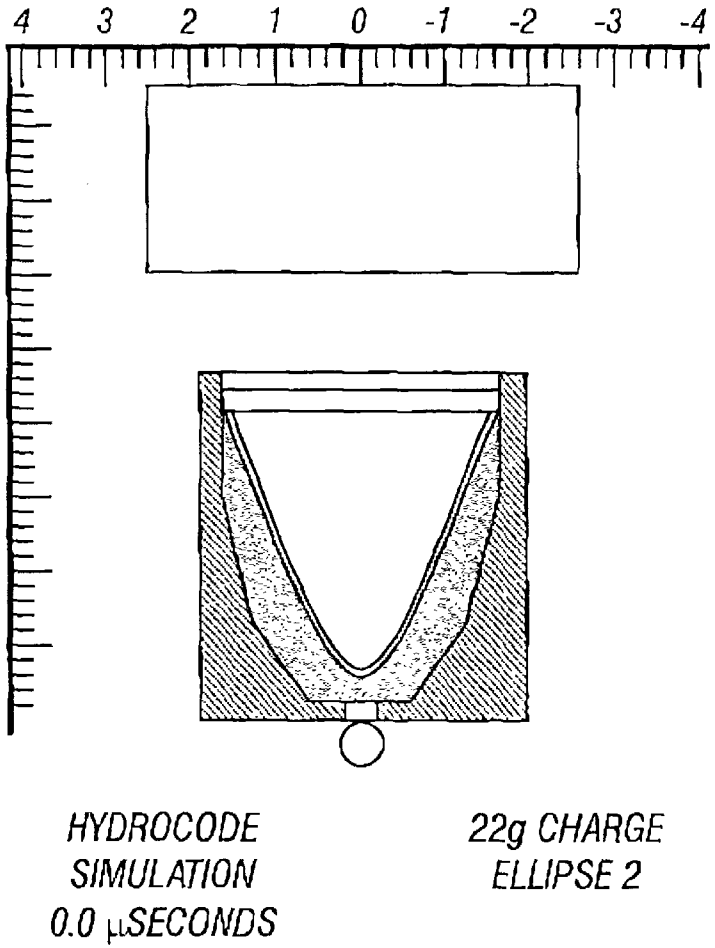
FIG. 13*a* is a side view from the widest portion of the charge.
Figure 14B:
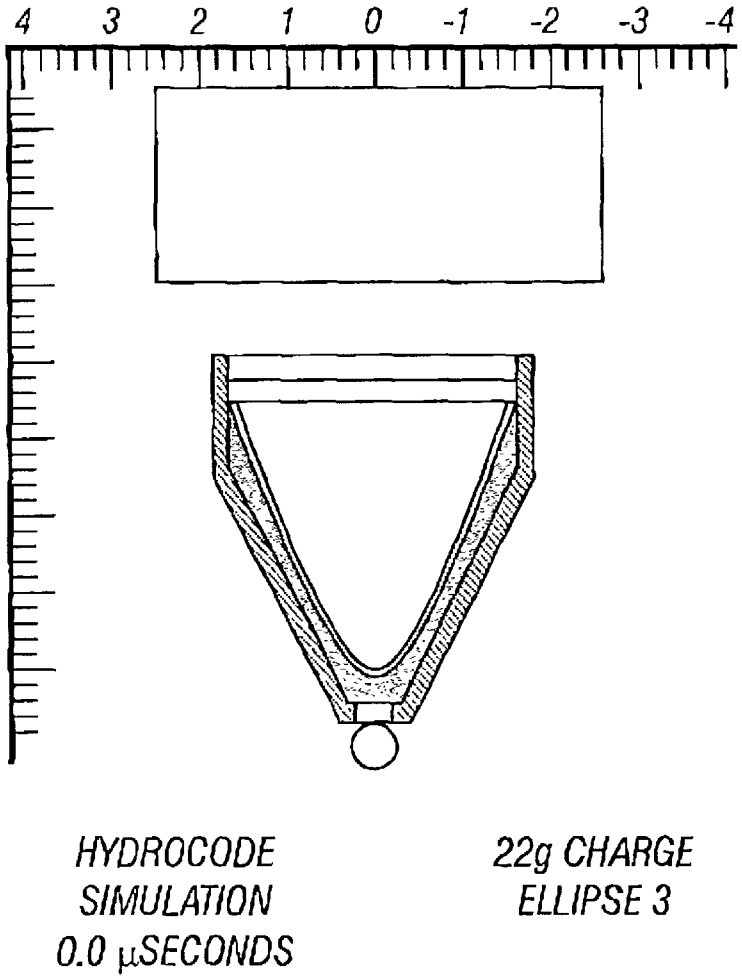
FIG. 14*b* is a view of the narrow side.
Figure 14A:
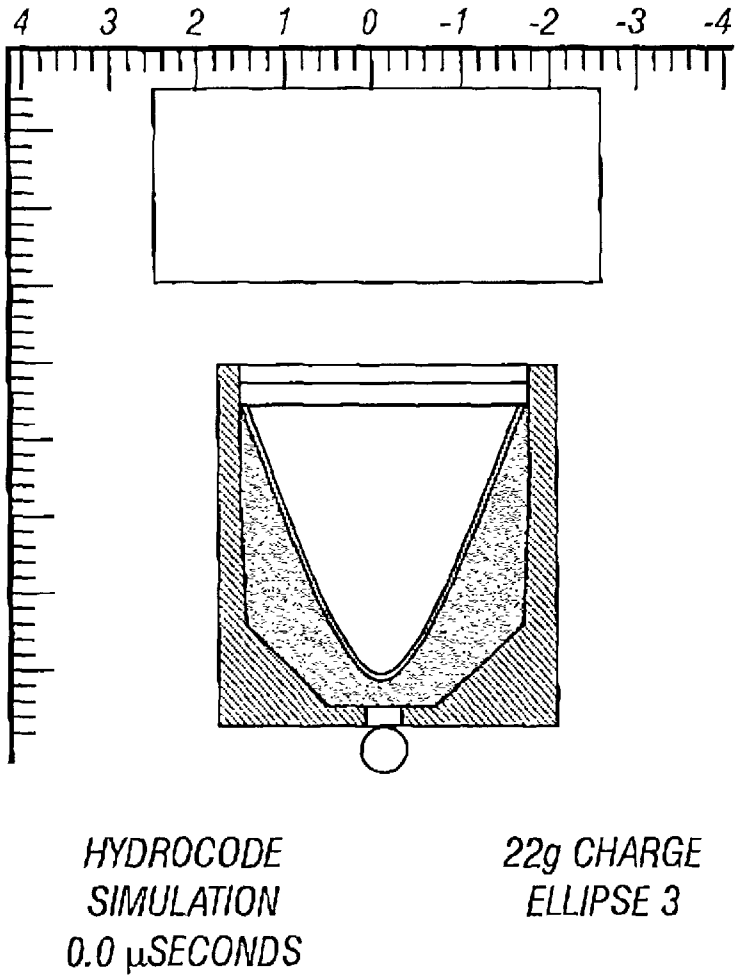
FIG. 14*a* is a side view from the widest portion of the charge.
Figure 15A:
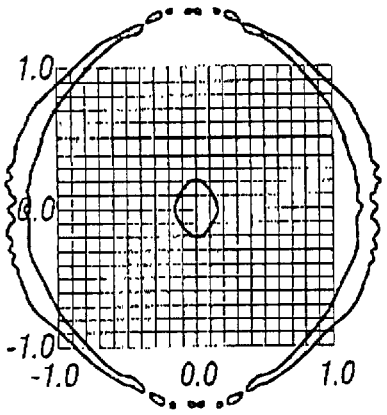
FIG. 15*a* (left) shows the jet midsection.
Figure 15B:
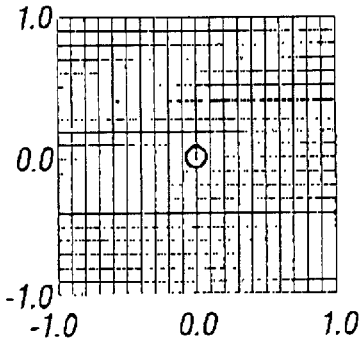
FIG. 15 is a computer-simulated picture of the collapsing liner and jet, viewed parallel with the trajectory. This Figure shows the jet produced (at 12.5 microseconds) from the modified shaped charge in FIG. 12.
Figure 16B:
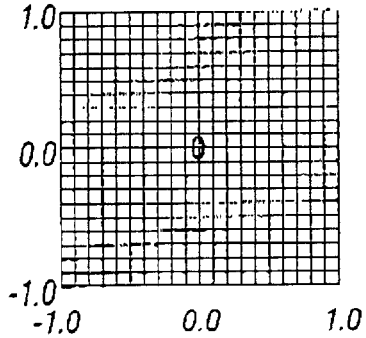
Figure 17B:
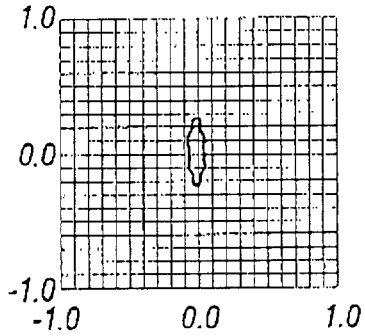

FIG. 12 is a computer-simulated picture of a modified shaped charge. The case geometry is clearly shown (both the interior and exterior portions). The case exterior was modified slightly. In FIG. 13, the case interior was modified; and in FIG. 14, both the case interior and exterior were substantially modified. The jets produced by these three case designs are shown in FIGS. 15–17. These figures are a view of a simulated firing of each of the three shaped charges in FIGS. 12–14. Specially, each is a view of the collapsing liner and jet, viewed along the axis in which jet propagates; the tip is shown at right (FIGS. 15*a*, 16*a*, and 17*a*) and the jet midsection is shown on the left (FIGS. 15*b*, 16*b*, and 17*b*).

As evidenced by FIG. 15, a shaped charge having a slightly modified case exterior (shown in FIG. 15) is sufficient to produce an elliptically shaped jet (and therefore an elliptically perforation) in a wellbore liner. The jet tip is shown in FIG. 15*a*; the midsection at 15*b*—both are 12.5 microseconds after detonation. The modified shaped charge shown in FIG. 13 (case interior changed slightly compared with a conventional case) produces an even more elliptically shaped jet, as shown in FIG. 16—both in the tip region (FIG. 16*b*) and the midsection (FIG. 16*a*). Finally, as evidenced by FIG. 17, more substantial modifications to both the interior and exterior of the case results in more highly elliptically shaped jets. Indeed, the case configuration of FIG. 14 produces a jet having an aspect ratio of greater than about 5:1. This jet will produce a perforation in a wellbore casing having an aspect ratio of less than 5:1, but still substantially elliptical in the vast majority of instances—depending upon the casing material, and most strongly upon the formation geology.

The shaped charges shown in FIGS. 12–14 can be further explained by reference to FIGS. 18 and 19. FIG. 18 is a side view schematic of a conventional shaped charge. A shaped charge's three primary components are clearly shown: the case 110, the liner 130, and the explosive juxtaposed between the case and liner, show at 120. This shaped charge is axi-symmetric.

By comparison, a shaped charge modified in accordance with the present Invention is shown in FIG. 19. This shaped charge is non axi-symmetric. Since it is non axi-symmetric, two side views need to be shown (19*a* and 19*c*); the corresponding front views are shown in 19*b* and 19*d*, respectively. As evidenced by FIGS. 19*a* and 19*c* (again, two different side views of the same shaped charge) when viewed in comparison with FIG. 18, clearly show the shape of the charge case, modified in accordance with (preferred embodiments of) the present Invention. In particular, FIG. 19*a* shows the case exterior, and FIG. 19*b*, the case interior, both of which are modified in preferred embodiments of the present Invention.

We wish also to note that the present Invention is not limited to the manner in which the perforations are "shot." In particularly preferred embodiment, they are shot with a conventional perforation apparatus, modified as discussed in Example 4, above. In other embodiments, the perforations may be shot using, for instance, the "BRIDGEBlASTER™" apparatus, a proprietary service developed and sold by Schlumberger, and originally intended for removal of scale from wellbores.

Having thus described the invention, what is claimed is:

1. A method comprising shaping an exterior of a case of a shaped charge to have an elliptical profile; and using the case to shoot at least one elliptically shaped perforation into a well casing or an uncased hole.

2. The method of claim 1, further comprising shaping the case to cause the case to have an elliptical cross-section.

3. A method comprising shaping an exterior of a case of a shaped charge to have a non-circular profile; and using the case to shoot at least one non-circular perforation into a geologic formation to form a perforation tunnel, wherein said perforation:

has its major axis substantially parallel to a plane perpendicular to an axis defined by the perforation tunnel; and said major axis is substantially aligned in a direction of maximum compressive stress in said plane.

4. The method of claim 3 wherein said non-circular perforation is substantially elliptically shaped.

5. The method of claim 4 wherein said perforation has an aspect ratio greater than 1.5.

6. The method of claim 5 wherein said major axis of said perforation deviates not more than 10° from another axis defined by the direction of maximum compressive stress.

7. The method of claim wherein said major axis of said perforation deviates not more than 15° from another axis defined by the direction of maximum compressive stress.

8. The method of claim 5 wherein said major axis of said perforation deviates not more than 20° from another axis defined by the direction of maximum compressive stress.

9. The method of claim 5 wherein said major axis of said perforation deviates not more than about 25° from another axis defined by the direction of maximum compressive stress.

10. The method of claim 5 wherein said perforation has an aspect of ratio of about 2 and said major axis of said perforation deviates not more than about 10° from another axis defined by the direction of maximum compressive stress.

11. The method of claim 5 wherein said perforation has an aspect of ratio of about 4 and said major axis of said perforation deviates not more than about 10° from another axis defined by the direction of maximum compressive stress.

12. The method of claim 5 wherein said perforation has an aspect ratio greater than 2.

13. The method of claim 3, further comprising shaping the case to cause the case to have an elliptical shape.

14. A method comprising shaping an exterior of a case of a shaped charge to have an elliptical profile; and using the case to shoot at least one elliptically shaped perforation into a geologic formation to form a perforation tunnel, said perforation:

has its major axis substantially parallel to a plane perpendicular to an axis defined by the perforation tunnel; and said major axis is substantially aligned in a direction of maximum compressive stress in said plane.

15. The method of claim 14 wherein shot density and perforation phasing are optimized to minimize the production of sand.

16. The method of claim 1, further comprising shapung the case to cause the case to have an elliptical cross-section.

17. A method comprising shaping an exterior of a case of a shaped charge to have an elliptical profile; and using the case to shoot at least one elliptically shaped perforation using a perforating gun having a suitably modified case exterior, wherein said perforation:

has its major axis substantially parallel to a plane perpendicular to an axis defined by the perforation tunnel; and said major axis is substantially aligned in a direction of maximum compressive stress in said plane.

18. The method of claim 17, further comprising shaping the case to cause the case to have an elliptical cross-section.

19. An apparatus comprised of a perforating gun in turn comprised of a shaped charge to shoot a perforation in a casing placed inside a wellbore comprising a liner, explosive, and case, an exterior of said case having an elliptical profile to produce an elliptically shaped perforation.

20. The apparatus of claim 19 wherein said case comprises a non-elliptical interior surface.

21. The apparatus of claim 19 wherein said case comprises an elliptical interior surface.

22. The apparatus of claim 21 wherein said case comprises an elliptical exterior surface.

23. The apparatus of claim 19 wherein said case comprises an elliptical interior surface and an elliptical exterior surface.

24. The apparatus of claim 19, wherein the case has a non-elliptical cross-section.

25. A method comprising shooting an elliptically shaped perforation into a geologic formation thus forming a perforation tunnel, using the apparatus as in any of claims 19–23 wherein said perforation:

has its major axis substantially parallel to a plane perpendicular to an axis defined by the perforation tunnel; and said major axis is substantially aligned in a direction of maximum compressive stress in said plane.

26. A method comprising shaping an exterior of a case of a shaped charge to have an elliptical profile; and using the case to shoot substantially elliptically shaped perforations into said formation thereby forming a perforation tunnel, said perforations orientated to maximize the stability of said formation contiguous to said perforation tunnel.

27. The method of claim 26 wherein said formation is cased.

28. The method of claim 26 wherein said formation is a carbonate formation.

29. The method of claim 26 wherein said perforation has an aspect ratio of at least about 3:1.

30. The method of claim 26 wherein the major axis of said perforation deviates not more than about 10° from a direction of maximum compressive stress exerted on the perforation by the formation.

31. The method of claim 26 comprising the additional step of performing a gravel pack treatment.

* * * * *